US009990867B1

(12) United States Patent
Shiao

(10) Patent No.: US 9,990,867 B1
(45) Date of Patent: Jun. 5, 2018

(54) NAMEPLATE ASSEMBLY FOR A BAG

(71) Applicant: Kun-Lin Shiao, Taoyuan (TW)

(72) Inventor: Kun-Lin Shiao, Taoyuan (TW)

( * ) Notice: Subject to any disclaimer, the term of this patent is extended or adjusted under 35 U.S.C. 154(b) by 0 days. days.

(21) Appl. No.: 15/726,350

(22) Filed: Oct. 5, 2017

(51) Int. Cl.
*G09F 7/04* (2006.01)
*G09F 7/18* (2006.01)
*A45C 13/42* (2006.01)

(52) U.S. Cl.
CPC ..... *G09F 7/04* (2013.01); *A45C 13/42* (2013.01); *G09F 7/18* (2013.01); *G09F 2007/1852* (2013.01); *G09F 2007/1882* (2013.01)

(58) Field of Classification Search
CPC ..... G09F 7/04; G09F 2007/1852; G09F 2007/1882; A45C 13/42
See application file for complete search history.

(56) References Cited

U.S. PATENT DOCUMENTS 4,137,657 A * 2/1979 Wardle ..... A44C 3/002 40/1.5
4,236,331 A * 12/1980 Mattson ..... A44C 3/001 40/1.5
4,961,275 A * 10/1990 Klein ..... A44C 3/001 40/1.5
5,283,966 A * 2/1994 Rader ..... A44C 3/001 40/1.5
5,369,899 A * 12/1994 Reeves ..... A44C 3/001 24/303
6,282,760 B1 * 9/2001 Mars ..... A44B 9/16 24/303
6,446,372 B1 * 9/2002 Reeves ..... A44C 3/001 24/303
6,484,424 B1 * 11/2002 Peterson ..... A44C 3/001 40/1.5
6,594,871 B2 * 7/2003 Hoffman ..... A44B 5/00 24/102 R
6,868,630 B2 * 3/2005 Kim ..... A47G 1/06 40/600
7,194,828 B2 * 3/2007 Peterson ..... A44C 3/001 40/1.5
7,966,755 B1 * 6/2011 Reeves ..... G01C 17/04 24/303
8,371,141 B2 * 2/2013 Richmond ..... A44C 25/002 24/303
9,392,828 B2 * 7/2016 Esagoff ..... A41D 27/20
2014/0310999 A1 * 10/2014 Quijano ..... G09F 7/18 40/600

* cited by examiner

*Primary Examiner* — Gary C Hoge
(74) *Attorney, Agent, or Firm* — Hershkovitz & Associates, PLLC; Abe Hershkovitz

(57) ABSTRACT

A nameplate assembly for a bag has a base, a nameplate and at least one connecting unit, the nameplate is disposed in an accommodating recess of the base, and the at least one connecting unit is mounted in at least one connecting recess of the base. The nameplate is connected and fixed on the base by the connecting unit. The base further includes a pressing recess formed in an end of the accommodating recess, the nameplate extending to a position above the pressing recess. The nameplate can be easily mounted on the base by the magnetic force from the connecting unit and can be easily removed by being pressed into the pressing recess. Therefore, the nameplate assembly is efficient in manufacturing and is easy to use.

6 Claims, 5 Drawing Sheets

NAMEPLATE ASSEMBLY FOR A BAG

BACKGROUND OF THE INVENTION

1. Field of the Invention

The present invention relates to a nameplate assembly, especially to a nameplate assembly that is mountable on a bag.

2. Description of the Prior Arts

With the ever-increasing awareness on customization, consumers tend to embroider or print their own marks or names on the products they purchase. On one hand, this makes the purchased item easy to recognize; on the other hand, this provides an arena for the consumers to exhibit their creativities and unique styles. It is widely used for items such as traveling bags, golf bags or other kinds of sport bags.

In the prior art, there are two conventional methods for making those marks on bags. The first one is to place the bag on a working platform and embroider the mark on the surface of the bag. The second one is to embroider the mark on a blank cloth nameplate in advance, and then mount the nameplate on the bag by sewing or adhesion.

But these two conventional methods have some defects.

First, the first method requires putting the whole bag on the platform to embroider the marks, but normally the bags are large in size or have irregular shapes, making the embroidering procedure complicated and inefficient.

Second, as the marks are made by embroidering, the two conventional methods are both inefficient for mass production of customized products within a short time.

Third, because the marks are ornaments of needlework, it is also hard to change the finished contents since this must involve elimination of the previous marks.

To overcome the shortcomings, the present invention provides a nameplate assembly for a bag to mitigate or obviate the aforementioned problems.

SUMMARY OF THE INVENTION

The main objective of the present invention is to provide a nameplate assembly for a bag that has a base mounted on the bag and a nameplate disposed on the base through magnetic attraction, on which the users can have their names or symbols printed, therefore the present invention is easy to install and the nameplate can be replaced conveniently.

The nameplate assembly for a bag has a base, a nameplate, and at least one connecting unit. Two opposite surfaces of the base are an outer surface and an inner surface. A pressing recess is formed through the outer surface. The nameplate is disposed on the outer surface of the base, and one end of the nameplate extends to a position above the pressing recess. The at least one connecting unit is mounted on the base and connects with the nameplate.

Given the foregoing structure of the nameplate assembly for a bag, the users only need to draw or print their names or symbols on the nameplate in advance, and then mount the nameplate on the base. The mounting of the base is easier than directly embroidering the symbols on the bags because it does not require precise processing. Meanwhile, the disposition of the nameplate is through the at least one connecting unit instead of needlework, and therefore it is also faster and easier in changing or replacing the nameplates.

In other words, the concept of mounting the nameplate, which resembles a name card, on the base is better in comparison with the conventional method of embroidering. Furthermore, the nameplate can be quickly removed from the base by pressing one end of the nameplate into the pressing recess, the opposite end of the nameplate will therefore be tilted up and disconnected from the connecting units, thus becoming available for grab and replacement, thereby facilitating convenience in changing to another nameplate with different names or symbols.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
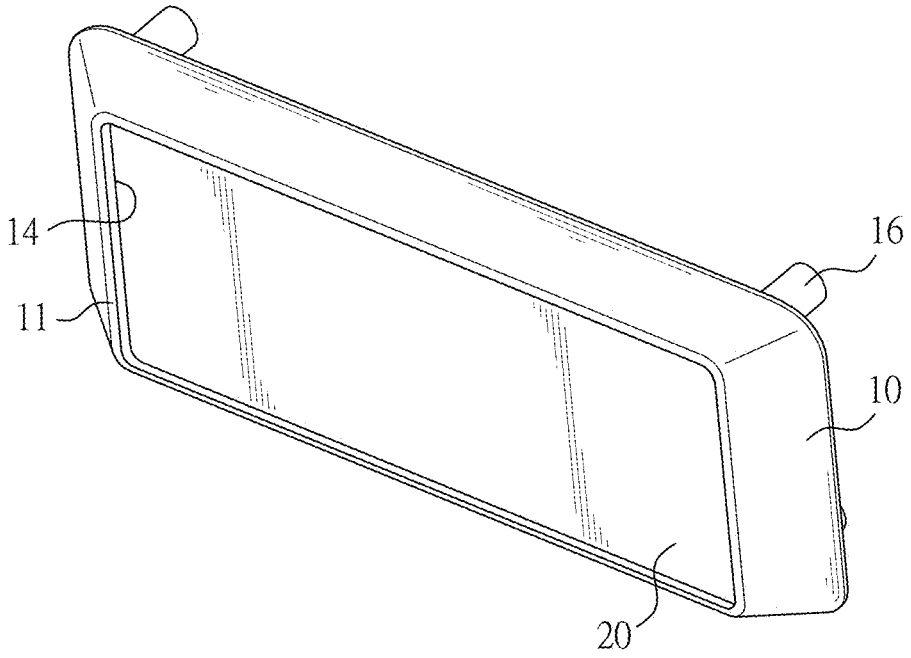
FIG. 1 is a perspective view of a nameplate assembly for a bag in accordance with the present invention.
Figure 2:
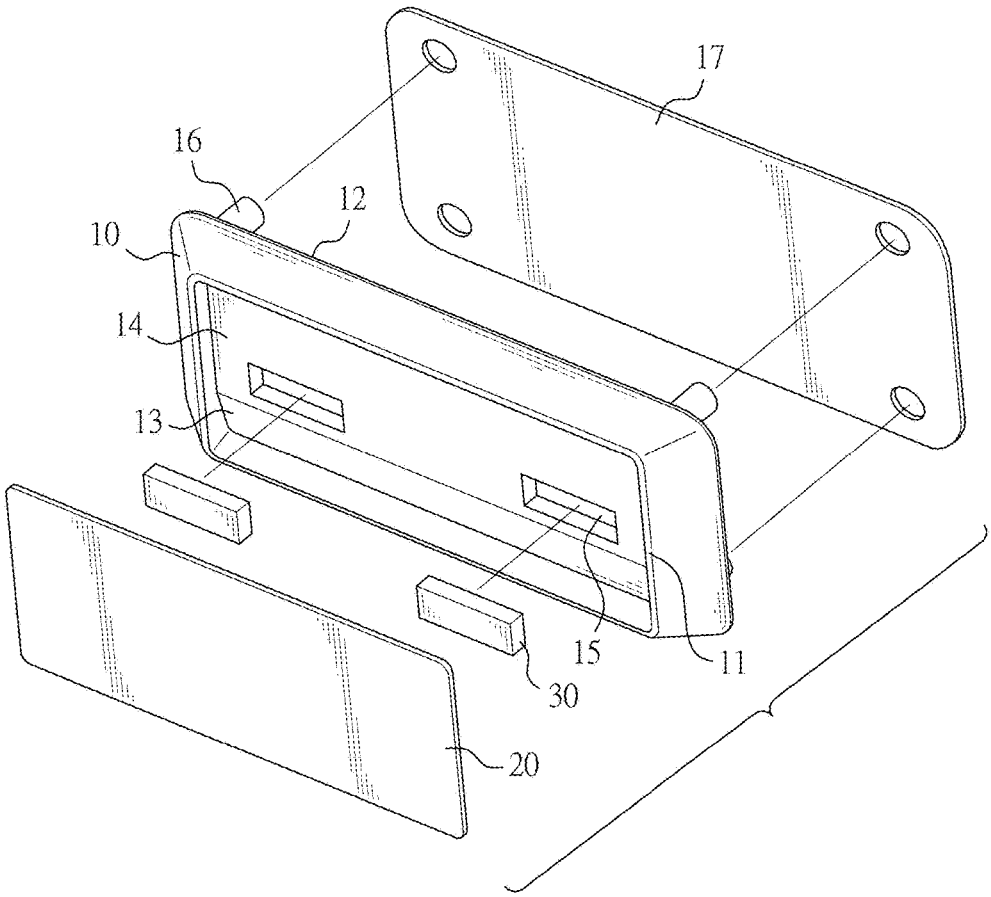
FIG. 2 is an exploded perspective view of the nameplate assembly for a bag in FIG. 1.

With reference to FIG. 1 and FIG. 2, a nameplate assembly for a bag in accordance with the present invention comprises a base 10, a nameplate 20 and at least one connecting unit 30. The nameplate 20 and the at least one connecting unit 30 are mounted on the base 10. Specifically, two opposite surfaces of the base 10 are an outer surface 11 and an inner surface 12, and the nameplate 20 is mounted on the outer surface 11.

With reference to FIG. 2, when viewed from the outer surface 11 toward the inner surface 12, the base 10 is rectangular and the surface area of the outer surface 11 is smaller than the surface area of the inner surface 12, which means four side surfaces of the base 10 extend outwardly from the outer surface 11 toward the inner surface 12, but the shape of the base 10 is not limited thereto.

In a preferred embodiment, the number of the at least one connecting unit 30 is, but not limited to, two.

Figure 3:
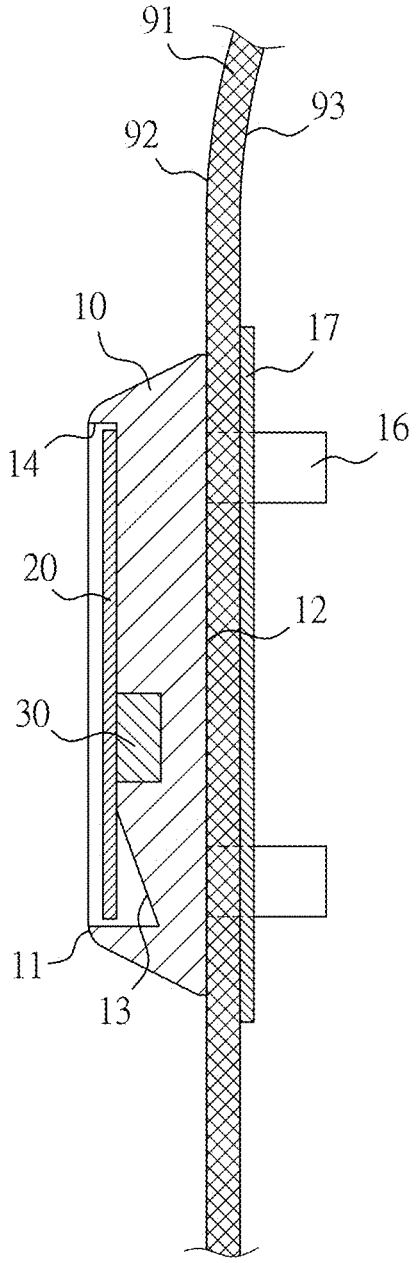
FIG. 3 is a cross-sectional side view of the nameplate assembly and a bag on which the nameplate is mounted.

With reference to FIG. 2 and FIG. 3, in the preferred embodiment, the two connecting units 30 are magnets, the nameplate 20 is made of magnetic metals, and therefore the nameplate 20 can be attracted by the magnetic force of the connecting units 30 and be mounted on the base 10. But the way the connecting units 30 connect with the nameplate 20 is not limited; the connecting units 30 can be made of materials other than magnets, so the nameplate 20 and the connecting units 30 are detachably interconnected through other means. For example, the connecting units 30 are hook and loop fasteners, and the nameplate 20 is thereby detachably connected with the connecting units 30 through fabrics and hooks.

Figure 4:
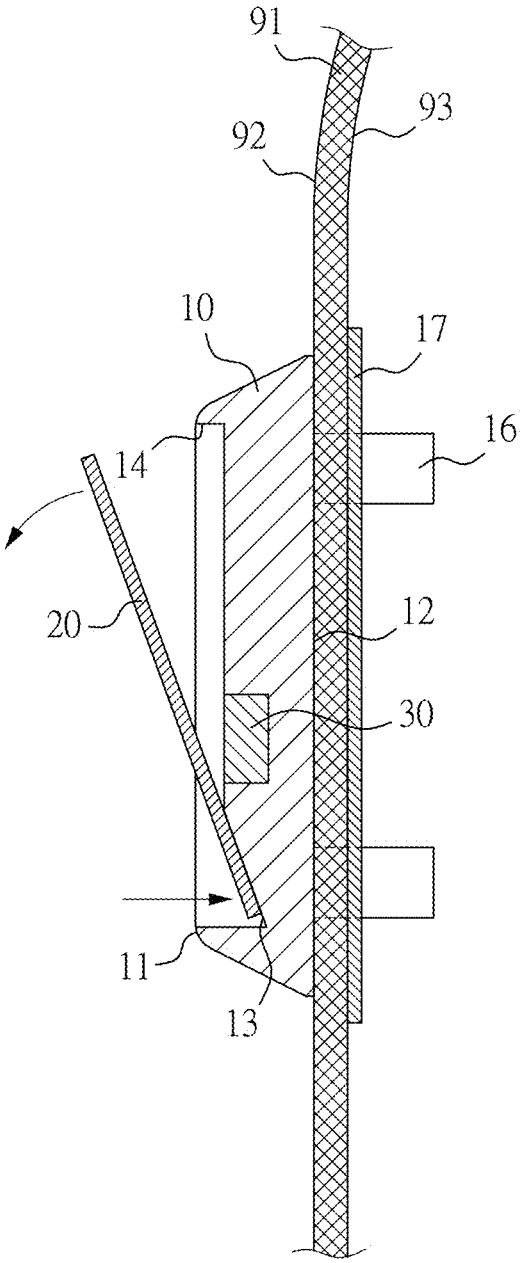
FIG. 4 is an operational view of the nameplate assembly in FIG. 3.

With reference to FIGS. 2, 3 and 4, the base 10 further comprises a pressing recess 13, an accommodating recess 14 and at least one connecting recess 15. The pressing recess 13, the accommodating recess 14 and the at least one connecting recess 15 are all mounted on the outer surface 11 of the base 10. In a preferred embodiment, the nameplate 20 is disposed in the accommodating recess 14, one end of the nameplate 20 extending to a position above the pressing recess 13. In another embodiment, the base 10 does not have the accommodating recess 14, and the nameplate 20 is directly disposed on the outer surface 11 and connected with the two connecting units 30.

With reference to FIG. 2 and FIG. 3, in a preferred embodiment, the number of the at least one connecting recess 15 is two, corresponding to the number of the connecting units 30. The two connecting recesses 15 are formed in the outer surface 11 of the base 10. More specifically, the two connecting recesses 15 are formed in, but not limited to, a bottom of the accommodating recess 14. The two connecting units 30 are respectively mounted in the two connecting recesses 15. The outer surfaces of the two connecting units 30 are flush with the bottom of the accommodating recess 14. The two connecting units 30 abut the nameplate 20. In another embodiment, the base 10 does not have the two connecting recesses 15, and the connecting units 30 are then directly mounted on the outer surface 11 and connected with the nameplate 20.

In a preferred embodiment, a bottom of the pressing recess 13 is an inclined surface which extends downwardly and toward the inner surface 12 of the base 10, the nameplate 20 is selectively attached on the inclined surface, but it is not limited thereto, as the pressing recess 13 can be a recess without an inclined bottom. More precisely, the pressing recess 13 is disposed adjacent to a side wall of the accommodating recess 14, and a depth of the pressing recess 13 progressively increases toward said side wall of the accommodating recess 14.

With reference to FIG. 2, FIG. 3 and FIG. 4, the base 10 further comprises at least one fixing unit 16 on the inner surface 12. In a preferred embodiment, the number of the at least one fixing unit 16 is four, the four fixing units 16 are mounted evenly on four corners of the inner surface 12 respectively, each one of the four fixing units 16 is a rod and extends outwardly, but the shape and the number of the fixing units 16 are not limited thereto.

The base 10 further comprises a fixing board 17. When the base 10 is mounted on an outer surface 92 of a bag 91, the fixing board 17 is mounted on an inner surface 93 of the bag 91, wherein the four fixing units 16 are mounted through the bag 91 and on the fixing board 17, so a side portion between the outer surface 92 and the inner surface 93 of the bag 91 is sandwiched between the fixing units 16 and the fixing board 17.

In a preferred embodiment, the fixing board 17 is made of a magnetic metal, so the connecting units 30 connect both the nameplate 20 and the fixing board 17. As shown above, when the connecting units 30 are not magnets, the fixing units 16 and the fixing board 17 can be interconnected by other means or the base 10 can be implemented without the fixing board 17, wherein the fixing units 16 directly hook the base 10 on the bag 91.

Figure 5:
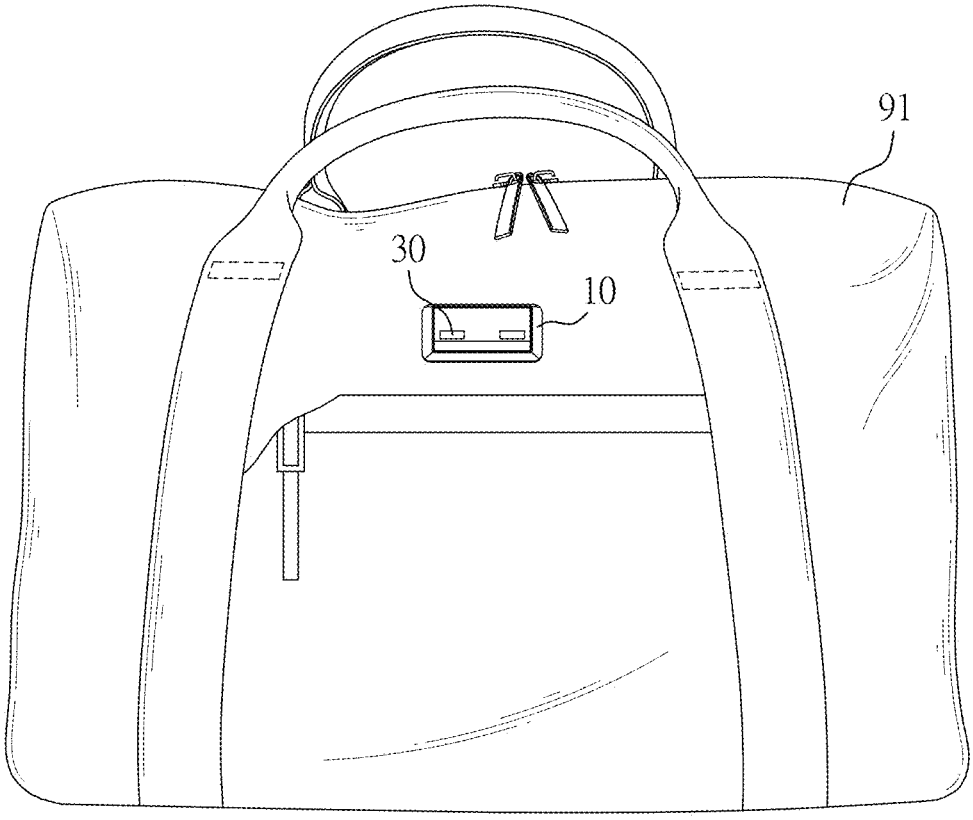
FIG. 5 is a front view of the nameplate assembly mounted on a bag.

With reference to FIG. 3, FIG. 4 and FIG. 5, for installing the present invention, the marks are formed on the nameplate 20 in advance, and the nameplate 20 is then disposed and fixed on the base 10 through the connecting units 30. The base 10 and the bag 91 are fixed to each other through the fixing units 16 and the fixing board 17, specifically, the bag 91 is sandwiched between the inner surface 12 of the base 10 and the fixing board 17, and the overall nameplate assembly of the present invention is then mounted on the bag 91. The installation of the present invention is therefore easy and fast. Besides, the nameplate 20 is mounted on the base 10 through the magnetic force of the connecting units 30, which means that the replacement of the nameplate 20 is also easy and fast. In other words, the present invention is easy to install, remove, and replace, and is also suitable for large-amount customization and fast production.

Moreover, because the nameplate 20 is easy to replace, customers can order several nameplates 20 for alternative use. When replacing the nameplate 20, one end of the nameplate 20 is pressed into the inclined bottom of the pressing recess 13 and attached on the inclined surface, while the other end is therefore tilted upward and is available for retrieval. As the nameplate 20 is disposed in the accommodating recess 14, it is not prone to accidental pressing and tilting. Therefore the nameplate assembly of the present invention facilitates ease and convenience in changing to the nameplates 20 of different texts or symbols or any graphical content.

In another embodiment, the base 10 does not have the fixing units 16 but is instead mounted on the bag 91 by sewing. As long as the nameplate 20 and the base 10 are easy to be connected and detached for removal or replacement of the nameplate 20 from the base 10, the present invention still has its advantage in manufacture and in use.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A nameplate assembly for a bag, the nameplate assembly comprising:

a base, two opposite surfaces of the base respectively being an outer surface and an inner surface, the base having a pressing recess formed in the outer surface; and at least one fixing unit protruding from the inner surface;

a nameplate mounted on the outer surface of the base, one end of the nameplate extending to a position above the pressing recess;

at least one connecting unit mounted on the base and connected to the nameplate; and a fixing board mounted around the at least one fixing unit, wherein a side portion of a bag is sandwiched between the fixing board and the inner surface of the base;

wherein the at least one connecting unit is a magnet and the at least one connecting unit magnetically attracts the nameplate and the fixing board.

2. The nameplate assembly as claimed in claim 1, wherein a bottom of the pressing recess is an inclined surface which extends toward the inner surface of the base, and the nameplate is selectively attached on the inclined surface.

3. The nameplate assembly as claimed in claim 2 further comprising an accommodating recess formed in the outer surface of the base, wherein the nameplate is disposed in the accommodating recess, the at least one connecting unit is disposed in the accommodating recess, the pressing recess is formed in a bottom of the accommodating recess, the pressing recess is disposed adjacent to a side wall of the accommodating recess, and a depth of the pressing recess progressively increases toward said side wall of the accommodating recess.

4. The nameplate assembly as claimed in claim 3, wherein at least one connecting recess is formed in the bottom of the accommodating recess, the at least one connecting unit is each respectively disposed in the at least one connecting recess, an outer surface of the at least one connecting unit is flush with the bottom of the accommodating recess, and the at least one connecting unit abuts the nameplate.

5. The nameplate assembly as claimed in claim 1 further comprising an accommodating recess formed in the outer surface of the base, wherein the nameplate is disposed in the accommodating recess, the at least one connecting unit is disposed in the accommodating recess, and the pressing recess is formed in a bottom of the accommodating recess.

6. The nameplate assembly as claimed in claim 1, wherein at least one connecting recess is formed in the outer surface of the base, the at least one connecting unit is each respectively disposed in the at least one connecting recess, an outer surface of the at least one connecting unit is flush with the outer surface of the base, and the at least one connecting unit abuts the nameplate.

* * * * *